United States Patent [19]

Ogihara et al.

[11] 4,104,859

[45] Aug. 8, 1978

[54] REVERSAL PREVENTING DEVICE OF ELECTRIC CLOCK

[75] Inventors: Masuo Ogihara, Chiba; Kozo Sato, Yatsukaido; Nobuo Shinozaki, Chiba; Yuzuru Takazawa, Togane; Yoichi Seki, Shisui, all of Japan

[73] Assignee: Seiko Koki Kabushiki Kaisha, Japan

[21] Appl. No.: 686,082

[22] Filed: May 13, 1976

[30] Foreign Application Priority Data

May 14, 1975 [JP] Japan ..... 50-63777[U]

[51] Int. Cl.[2] ..... G04B 19/02; G04C 3/00

[52] U.S. Cl. ..... 58/23 D; 58/125 R; 310/37; 310/40 MM; 310/49 R; 310/83

[58] Field of Search ..... 58/23 D, 116 R, 125 R; 310/36–39, 40 MM, 49 R, 83

[56] References Cited

U.S. PATENT DOCUMENTS

| | | | |
|---|---|---|---|
| 3,783,608 | 1/1974 | Miyazawa | 58/23 D X |
| 3,795,097 | 3/1974 | Meitinger | 58/23 D |
| 3,978,654 | 9/1976 | Koike et al. | 58/23 D |

*Primary Examiner*—Stanley J. Witkowski

*Attorney, Agent, or Firm*—Robert E. Burns; Emmanuel J. Lobato; Bruce L. Adams

[57] ABSTRACT

A driving wheel is mounted on the output shaft of a step motor, and a driven wheel engaging with gear wheels on which pointers are set is driven by said driving wheel. The driving wheel and the drive wheel have respective peripheral portions effective to couple the driving wheel with the driven wheel to rotate the driven wheel as the driving wheel rotates of an angular interval of rotation, and for thereafter disengaging the driving member from the driven member.

In order to fix the position of a pointer after the driving wheel has finished rotating the driven wheel, the reversal preventing mechanism acts on the said driven wheel or the driving wheel. The driving wheel is driven by a stepping motor having a rotor which intermittently rotates in one direction through a predetermined angular interval to a rest position. The driven wheel is in turn intermittently rotated by the driving wheel to intermittently change the position of the pointer.

6 Claims, 5 Drawing Figures

REVERSAL PREVENTING DEVICE OF ELECTRIC CLOCK

BACKGROUND OF THE INVENTION

The present invention relates to a reversal preventing device of an electric clock mechanism constructed in such a way that the pointers are shifted intermittently by a step motor, wherein the vibration of the second hand has been remarkably reduced.

Heretofore, in an electric clock provided with a step motor having a rotor which is rotated by a definite angle in one direction upon each driving pulse, a drive train was generally used wherein the pointers such as the second hand are intermittently moved by connecting the drive train of gear wheels to a pinion directly connected to the rotor. However, in such a mechanism, the movement of the rotor is transferred undamped to the second hand, so that when the rotor running in step with each driving pulse is stopped, the vibration caused by the inertia thereof is transferred undamped to the second hand and appears in the second hand movement as a vibration. This vibration makes it difficult to read the time.

In order to solve this defect, two methods were hitherto considered, one is a method of loading frictional pieces on the train of gear wheels directly connected to the second hand, or of making use of the action of click pieces. But in such a device the output of the step motor must be large enough to ensure driving of the resulting load which is larger than that necessary to drive just the train of gear wheels; moreover, in case a battery is used as the electric power source, there is a disadvantage in that its life is reduced.

The other method consists in reducing the inertia of the rotor. But in this method, it is needed to minimize the size of the motor as far as possible, which leads to a small output torque of the motor resulting in a decreased reliability. In addition, to elevate this torque characteristic, it is necessary to use magnetic materials for obtaining high energy, which is disadvantageous in that the cost is increased.

Consequently, this invention aims at eliminating the above-mentioned defects without degrading the starting characteristic of the step motor.

BRIEF DESCRIPTION OF THE DRAWINGS

The drawings show embodiment of this invention, in which.

DESCRIPTION OF THE PREFERRED EMBODIMENTS

Figure 1:
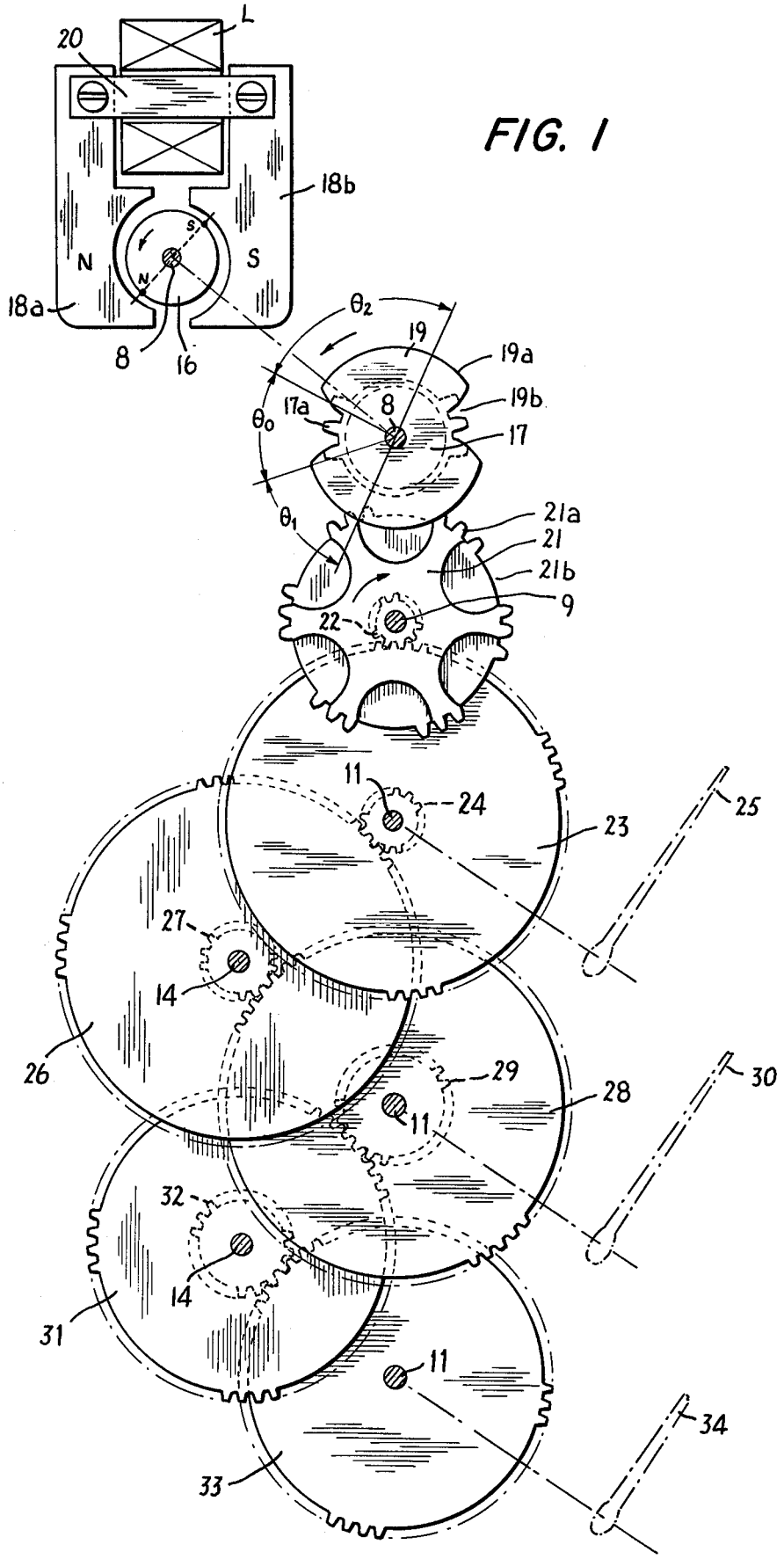
FIG. 1 shows a plan of the 1st embodiment.
Figure 2:
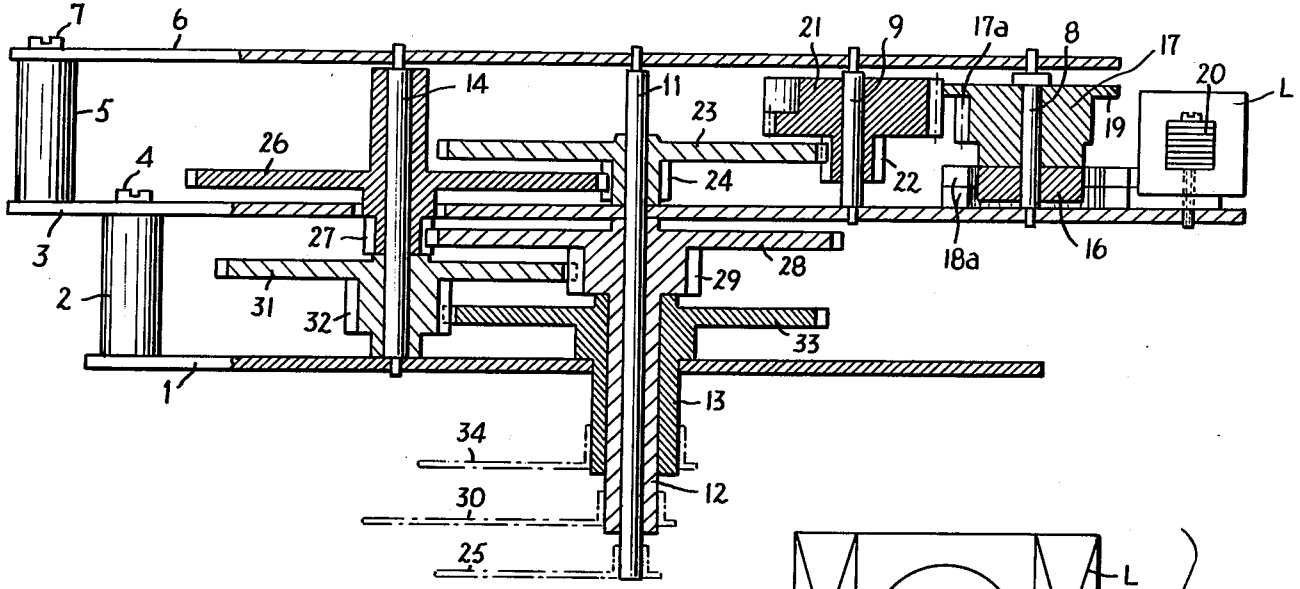
FIG. 2 a cross-sectional view of FIG. 1.

In the following is described in detail the embodiments shown in the drawings. FIG. 2 shows a cross section of FIG. 1. To a base plate 1 is fixed a column 2, an intermediate plate 3 to which a 2nd column 5 is fixed is attached to said column 2 by a screw 4, and an upper plate 6 which is fixed to said 2nd column 5 by a screw 7. Shafts 8, 9 and a second-hand shaft 11 are rotatably supported by the intermediate plate 3 and the upper plate 6, and the second-hand shaft 11 together with a shaft 14 is also fitted to the base plate 1.

To a shaft 8 are fixed a rotor 16 magnetized with two poles of N and S magnetic polarity at the periphery thereof, and a driving wheel 17 and a circular plate 19. Said driving wheel 17 is provided with two sets of shift teeth **17*a*, and the circular plate 17, 19 is provide with a circular are part 19*a* and a notched part 19*b*. L is a coil in which an alternating current flows and an iron core 20 is inserted into this coil. And to said iron core 20 is fixed the intermediate plate 3 through two sets of stators 18*a*, 18*b* by means of screws, and a semi-circular magnetic pole is formed for the rotor 16** on the opposed inside surfaces of the stators. Since the center of the rotor relative to the stators is as shown in the figure, the rotor is made to stop at a position where said magnetic stator poles and the poles of the rotor approach most closely.

On the other hand, to the shaft 9 are fixed an idler 21 having six peripheral sections free of teeth in which teeth independent of and which would not engage the driving wheel 17 are cut off over the whole periphery and an 1st pinion 22. And in the static state, the driving wheel 17 and the circular plate 19 are at the positions where the shifting action is not performed as indicated by the drawing and the static state positions of the driving wheel 17 and plate 19 correspond with the stopping position of the afore-mentioned rotor. Conversely, the peripheral tooth-free portion **21*b* of the idler 21 and the circular part 19*a* of said circular part 19 correspond, and the group of the three teeth 21*a* of the idler between the tooth-free sections 21*b* are fixed by said circular part 19*a***.

A second-unit gear wheel 23 engaged with a 1st pinion 22, a 2nd pinion 24 and a second-hand are fixed to the shaft 11 a train of wheels beyond the 2nd pinion 24 transfer rotary motion to a minute-hand wheel 28 and an hour-hand wheel 33.

Next, the operation of the above embodiment is described.

In a state when a current does not flow in the coil L, since the rotor 16 is at rest in a position where the poles S, N thereof are closest to the inner pole surface of the stators **18*a*, 18*b*, the rotor is made to stop at an angle of about 45° relative to the center of the magnetic field of each stator. If, in the static state, a current begins to flow in the coil L in such a direction that an N-pole is produced in the stator 18*a* and an S-pole is produced in the stator 18*b*, the rotor 16 will start a counter-clockwise rotation. At this moment, since the shift teeth 17*a* of the driving wheel 17 are at a position so as not to fit with the teeth 21*a* of the idler, and because the driving wheel 17 is directly connected to the rotor 16, only the driving wheel 17 and circular plate 19 begin to rotate with the rotor, while the train of wheels beyond the idler 21** are left at a standstill.

In this way, when the rotor 16 rotates through a definite angle (former half play angle ; $\theta 1$), the engagement of the circular part (**19*a*) of the circular plate 19 and the idler 21 is released, and at the same time the shift teeth 17*a* of the driving wheel 17 engage with the teeth 21*a* of the idler. Therefore, the rotation of the rotor 16 is transferred as it is to the train of wheels beyond the idler 21**.

Figure 3:
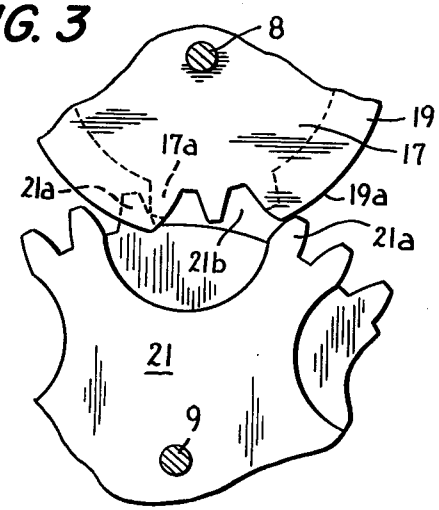
FIG. 3 an explanatory figure, showing details of the structure illustrated in FIG. 1, FIG. 4 a plan of the 2nd embodiment, and FIG. 5 an explanatory figure showing the operation of the structure illustrated in FIG. 4.

Thereafter, the rotor 16 is rotated further by a definite angle, the engagement between the shift teeth **17*a* of the driving wheel and the teeth of the idler is interrupted and the circular part 19*a* of the circular plate 19** fits between the group of three teeth 21*a* of the idler, so that the idler 21 stops its rotation. Consequently, the rotation of the idler 21 advanced through a definite angle is transferred to the second-hand wheel as a rotation angle of 6° that corresponds to one second on the timepiece dial plate. And even after the idler 21 is brought to a stop, the rotor 16 is able to rotate through θ2 degrees (the latter half play angle) and stops at a position displaced by 180° from the initial one. Actually the driving wheel 17 rotates counterclockwise further than 180° due to its inertia and then makes a clockwise rotation back to the static position. Namely, the driving wheel 17 decelerates gradually with vibration and oscillation and finally stops at a specified static or rest position (a position displaced by 180° from the initial position). At this moment, if the fluctuation angle of the driving wheel 17 is large, when the driving wheel rotates clockwise, the shift teeth 17*a* thereof engage with the teeth 21*a* of the idler intending to make the idler 21 rotate counterclockwise. However, as shown in FIG. 3 the circular part 19*a* of the circular plate 19 of the driving wheel 17 enters into the rotation locus of the teeth 21*a* of the idler at the cut away part of the idler 21 that is indifferent to the rotation of the driving wheel 17, so as to impede the idler 21 from making a counterclockwise rotation. Therefore, the transfer of rotary motion through the train of wheels beyond the idler 21 is interrupted without any bad influence.

Figure 4:
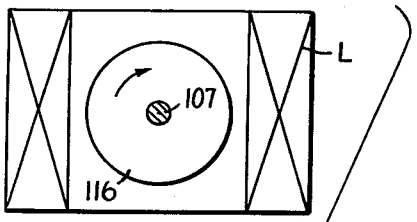

FIG. 4 shows the 2nd embodiment, wherein the synchronous motor, the intermittent motion mechanism, and the reversal preventing means are different from the 1st embodiment, and the train of wheels beyond the pinion 22 is the same as in the 1st embodiment.

In the following is described the construction of the 2nd embodiment.

To a shaft 107 is fixed the 1st rotor 116 provided with two magnetic poles N, S around the rotor periphery. And to a shaft 108 are fixed the 2nd rotor 111 provide with two magnetic poles N, S in correspondence with said 1st rotor 116, and the driving wheel 110 and a cam plate 112. Two pins 110*a* are fixed to said driving wheel 110 and the pins 110*a* are positioned on a straight line passing through the shafts 108. The cam plate 112 is provided with two cams 112*a*. A shaft 109 has the 1st pinion 122 and a disk wheel 115 provided with six radial grooves 115*a* fixed to it. The radial grooves 115*a* are spaced so that they are successively engaged by a pin 110*a* as the driving wheel 110 rotates. A plate spring 120 is fixed to the intermediate plate 3 with screws and the like at a position where a small gap is present at the concentric part 112*b* of the cam plate 112 when the driving wheel 110 is at rest, as shown in FIG. 5.

Next, a description of the operation of the second embodiment follows:

When an alternating current flows in the coil L, the 1st rotor 116 begins to rotate clockwise. Consequently, the 2nd rotor 111 that is magnetically connected with the 1st rotor 116 begins to rotate counterclockwise. The driving wheel 110 rotates at a certain definite angle (the former half play angle : θ1 independently of the grooved disk wheel 115, until a pin 110*a* of the driving wheel 110 enters into the groove 115*a* of the grooved disk wheel 115 causing the grooved disk wheel 115 to rotate. Finally the driving wheel 110 stops at a position displaced by 180° from the initial position. As described in detail with regard to the 1st embodiment, said driving wheel 110 produces vibration at this moment which is caused by the inertia thereof and comes to the definite rest position after the vibration has attenuated gradually.

Figure 5:
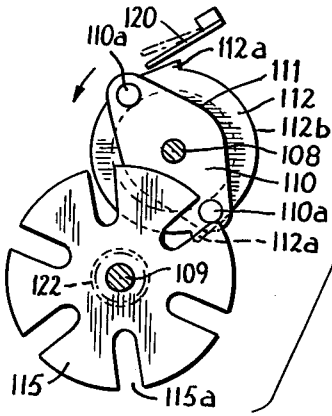
Figure 5:
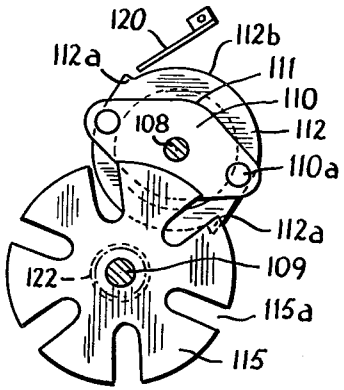

In the 2nd embodiment, illustrated in FIGS. 4 and 5 rotation direction reversal is achieved by utilizing a spring action of the plate spring 120 which is flexed outward by the cam portion 112*a* of the cam plate 112 until the driving wheel 110 has finished engaging with the grooved disk wheel 15 to rotate the same, and while the driving wheel 110 rotates counterclockwise further until reaching the definite or rest position. As shown in FIG. 5, when said driving wheel 110 rotates up to the definite position, said plate spring 120 returns to the original unflexed position by its own restoring force, and enters into the rotation locus of the cam plate 112*a* for impeding the clockwise rotation of the driving wheel 110. Therefore, at the moment when the driving wheel 110 has finished engaging with the grooved disk wheel 115 for rotating the same, rotation of the driving wheel which it is not engaged with the grooved disk wheel 115 is interrupted without imparting any motion to the second-hand.

We claim:

1. In an electronic timepiece, the combination comprising:

a stepping motor having a rotor which intermittently rotates in one direction through a predetermined angular interval to a rest position; a rotary driving member driven by said rotor to rotate in one direction during rotation of said rotor and which may develop an oscillation about a rest position after said rotor has rotated through the predetermined angular interval; indicating means including an indicator which changes position for visually indicating the value of a variable; a rotary driven member for driving said indicating means to change the indicator position; said rotary driving member and said rotary driven member together include coupling means for coupling said driving member with said driven member to rotate said driven member in a forward direction as said driving member rotates through a middle portion of its interval of angular rotation, and for disengaging said driving member from said driven member after said driving member has rotated through a middle portion of its interval of angular rotation so that said rotary driven member is intermittently rotated by said rotary driving member to intermittently change the position of said indicator; and means for preventing said driving member from rotating said driven member in a reverse direction by oscillation of said driving member at the end of the interval of rotation of said driving member.

2. In an electronic timepiece according to claim 1, wherein said driving member comprises a first wheel mounted for axial rotation, said driven member comprises a second wheel mounted for axial rotation, and said first and second wheels have peripheral edge portions defining said coupling means.

3. In an electronic timepiece according to claim 1 wherein said driving member comprises a driving wheel mounted for axial rotation and having at least one group of gear teeth extending peripherally of said driving wheel and bounded by peripheral sections of said driving wheel free of gear teeth, and a circular plate concentric with said driving wheel and having a diameter greater than that of said driving wheel and mounted for axial rotation therewith, said circular plate having a peripheral notch at the periphery thereof adjacent each group of teeth of said driving wheel; and wherein said driven member comprises a second wheel mounted for axial rotation, said second wheel having groups of gear teeth spaced around the periphery thereof and separated by peripheral sections free of gear teeth, and said second wheel having a second set of teeth at a surface thereof spaced peripherally of said second wheel; said driving member and said driven member being relatively positioned with the respective peripheries of said first and second wheels adjacent and with said circular plate partially overlying the surface of said second wheel, said gear teeth of said first wheel engaging successive ones of said groups of gear teeth of said second wheel for intermittently rotating said second wheel through an angle defined by an angular separation between successive ones of said groups of gear teeth, and said second set of teeth being spaced relative to said teeth spaced around the periphery of said second wheel to clear the notches in the circular periphery of said circular plate to allow the teeth of said first wheel to drive said second wheel in the forward direction and to engage the periphery of said circular plate to prevent the teeth of said first wheel from engaging said groups of teeth of said second wheel to drive said second wheel in the reverse direction.

4. In an electronic timepiece according to claim 1, wherein said driving member comprises a first rotary wheel mounted for axial rotation and having at least one pin extending from a major surface thereof at a position eccentric to the driving member axis of rotation; and wherein said driven member comprises a second rotary wheel mounted for axial rotation and having a plurality of radial slots for receiving said pin therein, said first and said second rotary wheels being relatively positioned for permitting said pin to engage with a one of said slots upon rotation of said driving member to rotate said driven member through an angular interval and thereafter disengage from said slot of said driven member, said radial slots being circumferentially spaced to permit successive engagement of said pin with said slots to intermittently rotate said driven member as said driving member rotates through the middle portion of its interval of angular rotation.

5. In an electronic timepiece according to claim 4, wherein at least one of said rotary members includes said means for preventing said driving member from rotating said driven member in a reverse direction.

6. In an electronic timepiece according to claim 5, wherein said means for preventing said driving member from rotating said driven member in a reverse direction comprises a cam plate mounted for rotation with said driving member and having peripheral cam portions defining spaced ratchet teeth about a periphery of said cam plate, and a resilient spring-like member defining a pawl positioned to undergo deflection by and ride over said cam portions as said driving member rotates in a direction effective to rotate said driven member in the forward direction, and to engage said cam portions to prevent said driving member from rotating said driven member in the reverse direction.

* * * * *